United States Patent [19]

Craemer

[11] Patent Number: 4,685,394

[45] Date of Patent: Aug. 11, 1987

[54] PHASE REGISTER CONTROL FOR PRINTER-SLOTTER MACHINE

[75] Inventor: Robert H. Craemer, Cherry Hill, N.J.

[73] Assignee: Molins Machine Company, Cherry Hill, N.J.

[21] Appl. No.: 831,211

[22] Filed: Feb. 20, 1986

[51] Int. Cl.[4] ..... B41F 13/24

[52] U.S. Cl. ..... 101/426; 101/226; 101/248

[58] Field of Search ..... 101/426, 226, 228, 232, 101/248, 217, 219, 181, 183

[56] References Cited

U.S. PATENT DOCUMENTS

| | | | |
|---|---|---|---|
| 2,677,971 | 5/1954 | Greenwood | 74/395 |
| 2,866,408 | 12/1958 | Stevenson | 101/219 |
| 2,975,706 | 3/1961 | Moser et al. | 101/181 |
| 3,003,403 | 10/1961 | Goettsch | 93/58.2 |
| 3,611,925 | 10/1971 | Kulwicki | 101/183 |
| 3,701,464 | 10/1972 | Crum | 101/181 |
| 3,915,090 | 10/1975 | Horst et al. | 101/426 |
| 4,264,957 | 4/1981 | Pautzke | 101/248 |
| 4,361,260 | 11/1982 | Hanlan | 101/248 |
| 4,495,583 | 1/1985 | Punater | 101/248 |
| 4,527,788 | 7/1985 | Masuda | 101/248 |
| 4,572,074 | 2/1986 | Guaraldi | 101/426 |
| 4,581,993 | 4/1986 | Schoneberger | 101/217 |

FOREIGN PATENT DOCUMENTS

| | | | |
|---|---|---|---|
| 96565 | 12/1983 | European Pat. Off. | 101/248 |
| 2753433 | 5/1979 | Fed. Rep. of Germany | 101/248 |
| 62185 | 5/1981 | Japan | 101/248 |
| 80464 | 7/1981 | Japan | 101/248 |
| 123665 | 7/1984 | Japan | 101/248 |
| 123666 | 7/1984 | Japan | 101/248 |

*Primary Examiner*—E. H. Eickholt

*Attorney, Agent, or Firm*—Seidel, Gonda, Goldhammer & Abbott

[57] ABSTRACT

The shafts of the sections of a printer-slotter machine are gear coupled and are set to the desired phase relation by a microcomputer control while coupled. The sections need not be de-coupled during set up. During normal operation, following set up, the section shafts are mechanically locked in phase register.

6 Claims, 3 Drawing Figures

PHASE REGISTER CONTROL FOR PRINTER-SLOTTER MACHINE

BACKGROUND OF THE INVENTION

This invention relates generally to printer-slotters for printing and slotting carton blanks which are usually of double-face corrugated paperboard. More particularly, the present invention is directed to a phase register control to maintain registration of operating shaft mounted cylinders during the fitting of a printing die or adjustment of the slotter heads.

In a conventional printer-slotter machine, each operation is performed successively by a module or section which may be opened for the fitting of attachments, cleaning and servicing. When the modules are in the closed position for operation, power is transmitted from a main drive motor in the feed end module by means of intermeshing gears in each module. If the printing module, for example, is separated from its adjustment modules, the power train gears are exposed and free to rotate.

When servicing the modules, the usual practice is for the operator to separate the modules so that the cylinders are readily accessible. In changing a printing die, for instance, the die is fastened to the print cylinder by staples or special clamps. Because of the length of the die, it is customary to rotate the cylinder to mount the die on the cylinder so that both ends of the die may be secured. Rotation of the cylinder affects the register of that station with respect to the rest of the machine. Similar problems may occur with the slotter cylinders or, if present, the die cutting cylinders, during set-up or adjustment of those machine sections, such that the cylinders will not mesh in register when the modules are reclosed.

To overcome this problem, timing marks have been placed on the cylinder shaft gears. Before the sections are reclosed, the gears are rotated (by hand, crank or otherwise) so that the timing marks are brought or set into proper relative alignment. This alignment must be maintained while the gears are re-engaged and the modules reclosed. If the operator forgets to set the timing prior to closing the machine, the initial sheets will be scrap and the machine will have to be opened again and the timing set correctly by rotating the gears. This is a time-consuming operation because trials must be made and blanks examined to establish that the proper relationship exists between a given cylinder and the cylinders in the remaining sections. The change may or may not be noted by the operator upon visual inspection of the gear timing marks. To restore the proper phase relationship, the sections must be decoupled again and the gear associated with the displaced cylinder shaft must be rotated to bring the timing mark back into alignment. If the change is not noted by the operator upon visual inspection of the gears, the machine will produce scrap sheets wherein the slots and/or printing are not correctly registered on each blank. An operator, upon noticing this condition must shut down the machine and then rotate the cylinders and gears so as to bring the elements into alignment. The result is a significant loss in production time and material.

Various mechanisms for setting the phase adjustment are well known in the industry. One type of mechanism is shown in U.S. Pat. No. 2,677,971. Other mechanisms may comprise a harmonic differential, a worm gear differential or the like. A worm gear differential is described in U.S. Pat. No. 3,003,403.

Numerous solutions have been proposed to insure alignment of the operating elements during separations of the modules. U.S. Pat. No. 2,975,706 for Printer Slotter Machine describes an arrangement in which each module is coupled to a splined shaft extending the length of the opened machine.

U.S. Pat. No. 2,866,408 for a Transmission Device for Rotary Printing Machines employs an analogous shaft provided with a beveled gear which may be coupled to each module.

Another arrangement is for a gear locking mechanism as in U.S. Pat. No. 3,611,925 Printer Slotter Module Gear Train Brake.

To eliminate the manual operations described above, a solution has been proposed in U.S. Pat. No. 4,527,788 issued July 9, 1985. In that patent, the machine sections are independently driven so as to eliminate the gear coupling between sections. The phase relationship between the shaft cylinders is then controlled electronically both at set up and during dynamic operation of the machine under normal conditions. The solution proposed in the patent requires a relatively sophisticated but unreliable and expensive electronic control and individual variable speed drives.

SUMMARY OF INVENTION

In a printer slotter, in which each operating cylinder is provided with means for adjusting the angular position of the cylinder shaft, each shaft includes a compensator motor and an encoder. Each encoder is connected to a digital counter to count the pulses generated by its associated encoder. Each pulse generated represents an increment of angular shaft displacement. Each counter is coupled to a comparator which is used to drive the compensator motor so as to rotate its associated shaft cylinder until the angular displacement of the shaft cylinder relative to the angular position of a reference cylinder in the printer slotter feed section is equal to the desired angular displacement of the shaft cylinder.

Accordingly, it is an object of the present invention to provide a simple, reliable and relatively inexpensive phase register control for a printer slotter which maintains correct register and timing without operator intervention.

A further object of this invention is to provide an automated printer slotter which maintains correct register and timing without operator intervention.

Another object of this invention is to provide an automated phase register control which may be easily retrofitted to conventional gear-driven printer slotters.

DETAILED DESCRIPTION OF THE INVENTION

Figure 1:
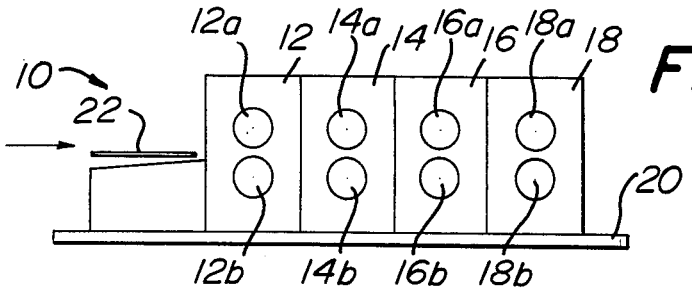
FIG. 1 is a diagrammatic representation of the printer-slotter machine showing the separable track-mounted sections.

Referring to the drawings, wherein like numerals indicate like elements, there is shown in FIG. 1 a conventional printer-slotter machine designated generally as 10. The machine includes a feeder section 12, printing sections 14 and 16 and slotter-scorer section 18, all sections being mounted on a track 20. A blank 22 is fed through the feeder section 12 to the remaining machine sections 14, 16, 18 wherein the blank is printed, slotted and scored. Each section includes a pair of shaft mounted cylinders designated 12*a, b,* 14*a, b,* 16*a, b* and 18*a, b.* Each cylinder is mounted for rotation with its associated shaft.

Figure 2:
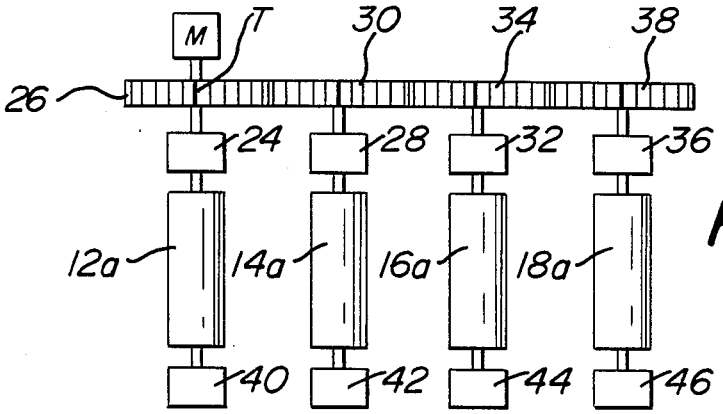
FIG. 2 is a plan diagram of the conventional gear coupled shaft cylinders as well as the shaft-mounted encoders of the present invention.

The cylinder shafts are gear coupled from section to section as shown in FIG. 2. Feed cylinder 12*a* is mounted on a shaft which is coupled by differential 24 and gear 26 to drive motor M. Print cylinder 14*a* is coupled by differential 28 to gear 30. Print cylinder 16*a* is coupled by differential 32 to gear 34. Cylinder 14*a* and cylinder 16*a* carry conventional printing plate elements (not shown). Slotter-scorer cylinder 18*a* is coupled by differential 36 to gear 38. Cylinder 18*a* carries the conventional slotting-scoring tools (not shown). Differentials 24, 28, 32, 36 are conventional harmonic or worm gear differentials or the like, well-known to the artisan. During operation, gears 26, 30, 34 and 38 are in meshing relation wherein the single drive motor M provides the drive power for all shaft cylinders.

Each gear is provided with timing mark T in the usual manner. The desired phase relation or relative angular positions among all cylinders can be set-up in the conventional semi-automatic procedure by separating the sections, rotating the gears so that the timing marks T are brought into alignment, closing the sections and then separately actuating each differential so as to rotate the cylinder shafts to bring the cylinders to their desired angular positions (while the gears are engaged with the timing marks in alignment).

In the present invention, a shaft encoder is mounted at the end of each cylinder shaft. See FIG. 2. Encoder 40 is mounted on the shaft carrying feed cylinder 12*a.* Encoder 40 serves as a reference encoder as described more fully hereafter. Encoder 42 is mounted at the end of the shaft carrying the print cylinder 14*a.* Encoder 44 is mounted at the end of the shaft carrying the print cylinder 16*a,* and encoder 46 is mounted at the end of the shaft carrying the slotting-scoring cylinder 18*a.* All encoders are preferably of the digital incremental type, although absolute digital encoders and analog shaft angle sensor-generators may also be employed as will become evident to the artisan from the following disclosure.

Figure 3:
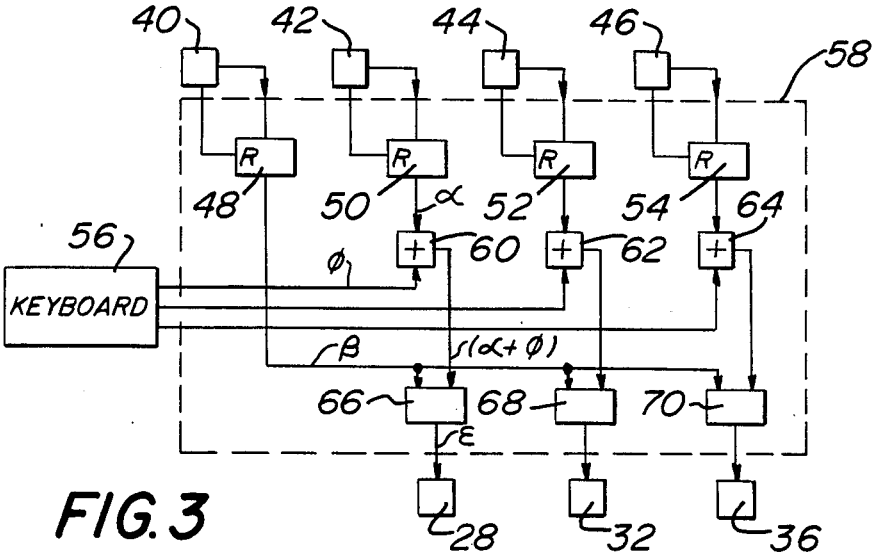
FIG. 3 is a block diagram of the phase register control of the present invention.

As shown in FIG. 3, each encoder is electrically connected to a digital counter. Encoder 40 is connected to counter 48. Encoder 42 is connected to counter 50. Encoder 44 is connected to counter 52. Encoder 46 is connected to counter 54. Each encoder generates a predetermined number of pulses per revolution of its associated shaft. Each counter counts the pulses generated by the associated encoder. Each pulse represents an increment of angular shaft displacement. All counters may be of the up/down type so as to indicate clockwise and counter clockwise angular shaft displacement. All counters are provided by the software programmed in a microprocessor 58.

To set up the desired phase relation among the shaft cylinders, an operator enters the desired angular displacements of the slotter-scorer and print cylinders, 14*a,* 16*a,* 18*a,* at the keyboard 56. See FIG. 3. The outputs of the keyboard are designated $\phi$. Each keyboard output $\phi$ represents the desired angular displacement of a cylinder with respect to the angular position of reference cylinder 12*a.* Each output $\phi$ is connected to an adder 60, 62, 64. All adders are provided by the software programmed in microprocessor 58.

Each of the outputs or counts of counters 50, 52 and 54 is designated $\alpha$ in FIG. 3. Each of these outputs represent actual angular displacement of a slotter-scorer or printing section shaft. The output of counter 48 is designated $\beta$ in FIG. 3. This output represents actual angular displacement of the reference (feeder) section shaft. Each shaft encoder 40, 42, 44, 46 generates one marker pulse per shaft revolution in addition to the other pulses generated by the encoder. Each marker pulse resets the counter associated with the shaft encoder.

The output $\alpha$ of each counter, 50, 52, 54 is added to the corresponding phase signal $\phi$ generated at keyboard 56 by adders 60, 62, 64. The output of each adder is therefore the sum $(\phi+\alpha)$, and this sum is compared to the output or count $\beta$ of counter 48 by comparators 66, 68, 70. All comparators are provided by the microprocessor software. The output of each comparator is designated $\epsilon$ in FIG. 3, and in each case $\epsilon=\beta-(\alpha+\phi)$. The output $\epsilon$ of a comparator represents the difference between (1) the actual angular displacement of shaft cylinder 14*a,* 16*a* or 18*a* relative to the angular position of the reference (feed) cylinder 12*a* and (2) the desired angular displacement of the cylinders 14*a,* 16*a* or 18*a* with respect to the angular position of the reference (feed) cylinder 12*a.* Thus, each comparator output $\epsilon$ is an error signal, and it is used to drive a differential 28, 32 or 36 so as to rotate the associated shaft cylinder 14*a,* 16*a* or 18*a* until the actual angular displacement of the shaft cylinder relative to the angular position of reference cylinder 12*a* is made equal to the desired angular displacement $\phi$ of the shaft cylinder with respect to the reference cylinder 12*a.* Thereafter, phase relation between all cylinders is locked mechanically by the gears and the differentials, which are prevented from further adjustment. During normal operation, the phase relationship among all cylinders can be maintained to an accuracy in the order of 5 mils.

From the foregoing, it can be appreciated that in the present invention none of the machine sections need be decoupled during set up of the shaft cylinders to achieve the desired phase relationship. Thus, set up of the shaft cylinders is achieved electronically and it is unnecessary to bring the gear timing marks into alignment. Moreover, since the shaft cylinders are gear coupled rather than being independently driven, the invention eliminates the problem of loss of phase register due to differing acceleration or deceleration rates and varying load characteristics of individual variable speed drives.

In addition, the invention is suited for easy retrofit to a conventional printer-slotter machine while retaining the single motor drive and gear coupling arrangement of the original machine. Should the phase register control of the present invention fail for any reason, due to microprocessor malfunction or the like, the shaft cylinders may be set up in the desired phase relationship utilizing the differentials 24, 28, 32, 36 and the gear timing marks in accordance with the conventional procedure (i.e., full manual back-up).

The present invention may be embodied in other specific forms without departing from the spirit or essential attributes thereof and, accordingly, reference should be made to the appended claims, rather than to the foregoing specification, as indicating the scope of the invention.

I claim:

1. Method of maintaining phase register among the shafts of the sections of a printer-slotter machine including a reference shaft, comprising:

coupling said shafts mechanically so that said shafts are rotatable in unison, sensing angular position of said reference shaft and generating a first signal representative thereof, sensing angular position of another machine section shaft and generating a second signal representative thereof, generating a third signal representative of desired angular position of said machine section shaft with respect to the angular position of said reference shaft, combining said first, second and third signals and generating an error signal based thereon, and separately rotating said machine section shaft in response to said error signal to bring said machine section shaft into the desired angular position with respect to the position of said reference shaft.

2. Method of maintaining phase register among the shafts of the section, of a printer-slotter machine according to claim 1 wherein said step of combining said first, second and third signals includes summing said second and third signals and comparing the sum with said first signal.

3. Apparatus for maintaining phase register among the shafts of the sections of a printer-slotter machine including a reference shaft, comprising:

gear means for coupling said section shafts so that said shafts are rotatable in unison, means for sensing angular position of said reference shaft and generating a first signal representative thereof, means for sensing angular position of another machine section shaft and generating a second signal representative thereof, user operable input means for selecting a desired angular position for said machine section shaft with respect to the angular position of said reference shaft and generating a third signal representative thereof, means for combining said first, second and third signals and generating an error signal based thereon, and means for separately rotating said machine section shaft in response to said error signal to bring said machine section shaft into the desired angular position with respect to the position of said reference shaft.

4. Apparatus for maintaining phase register among the shafts of the sections of a printer-slotter machine according to claim 3 wherein said user operable input means comprises a keyboard and wherein said means for combining said first, second and third signals includes a programmed microprocessor operatively coupled to the keyboard and to said means for sensing angular position of said reference and machine section shafts.

5. Apparatus for maintaining phase register among the shafts of the sections of a printer-slotter machine according to claim 3 wherein said means for separately rotating said machine section shaft includes a differential coupling said machine section shaft to a gear associated therewith.

6. Apparatus for maintaining phase register among the shafts of the sections of a printer-slotter machine according to claim 5 wherein said means for sensing angular position of said reference and machine section shafts are encoders.

* * * * *